US010463178B2

(12) United States Patent
Coffey

(10) Patent No.: US 10,463,178 B2
(45) Date of Patent: Nov. 5, 2019

(54) STRUCTURED BLANKET ASSEMBLY

(71) Applicant: Joseph Cody Coffey, Staten Island, NY (US)

(72) Inventor: Joseph Cody Coffey, Staten Island, NY (US)

( * ) Notice: Subject to any disclaimer, the term of this patent is extended or adjusted under 35 U.S.C. 154(b) by 453 days.

(21) Appl. No.: 15/141,286

(22) Filed: Apr. 28, 2016

(65) Prior Publication Data

US 2017/0055736 A1 Mar. 2, 2017

Related U.S. Application Data

(60) Provisional application No. 62/213,065, filed on Sep. 1, 2015.

(51) Int. Cl.
*A47G 9/06* (2006.01)

(52) U.S. Cl.
CPC ..... *A47G 9/062* (2013.01)

(58) Field of Classification Search
CPC ..... A47G 9/062; A47D 13/063; A47D 7/002; A47D 9/005; E04H 15/003
See application file for complete search history.

(56) References Cited

U.S. PATENT DOCUMENTS 2,950,484 A * 8/1960 Jaffe ..... A47K 3/064 229/117.07
3,023,753 A * 3/1962 Wheless ..... A61N 5/06 126/682
4,376,318 A * 3/1983 Cirillo ..... A47D 13/063 5/114
4,709,430 A 12/1987 Nicoll
4,726,084 A * 2/1988 Keserovich ..... A47G 9/062 5/417
4,785,486 A * 11/1988 Viesturs ..... A47K 3/06 4/585
4,860,777 A 8/1989 Orlando
4,999,863 A * 3/1991 Kane ..... A45C 9/00 190/2
5,018,230 A 5/1991 Steberger
5,085,212 A * 2/1992 DeCosta ..... E04H 15/003 4/526
5,115,524 A * 5/1992 Antosko ..... A47D 9/005 229/103
5,206,964 A * 5/1993 Wilson, Sr. ..... A47G 9/062 5/417
5,299,331 A 4/1994 Badillo
5,473,785 A * 12/1995 Lager ..... A47D 9/005 5/420
5,551,106 A * 9/1996 Schacht ..... A47D 13/063 5/99.1
5,711,336 A * 1/1998 Nirmel ..... E04H 15/003 135/116
7,216,381 B1 * 5/2007 Setzer ..... E04B 2/7425 160/135
7,607,182 B1 10/2009 Weiner
8,365,752 B1 * 2/2013 Fortin ..... A61N 5/0614 135/115

(Continued)

*Primary Examiner* — Eric J Kurilla
(74) *Attorney, Agent, or Firm* — Orrick, Herrington & Sutcliffe LLP; Richard Martinelli

(57) ABSTRACT

A structured blanket assembly for use in locations such as a beach which provides for end and side walls to prevent unwanted materials from getting on blanket, while allowing for disassembly for transport and cleaning.

6 Claims, 6 Drawing Sheets

(56) References Cited

U.S. PATENT DOCUMENTS

| | | | | |
|---|---|---|---|---|
| 8,595,870 | B1 * | 12/2013 | Lorenzo | A47D 13/063 5/98.1 |
| 2005/0136793 | A1 * | 6/2005 | Strunk | A47D 13/063 446/487 |
| 2007/0245494 | A1 * | 10/2007 | Dockendorf | A45C 9/00 5/655 |
| 2007/0277321 | A1 * | 12/2007 | Leach | A47D 5/006 5/655 |
| 2009/0007337 | A1 * | 1/2009 | Mese | A47D 13/06 5/655 |
| 2009/0205140 | A1 * | 8/2009 | Reese | A47D 13/063 5/714 |
| 2011/0119832 | A1 * | 5/2011 | Hung | A47D 9/005 5/655 |
| 2012/0063702 | A1 * | 3/2012 | Daugherty | A47D 9/005 383/4 |
| 2013/0008617 | A1 | 1/2013 | Rivera | |
| 2014/0208505 | A1 * | 7/2014 | Burkholder | A47D 9/005 5/99.1 |
| 2016/0120340 | A1 * | 5/2016 | Snep | A47G 9/062 5/420 |
| 2016/0143453 | A1 * | 5/2016 | Shapiro | A47D 13/063 256/25 |

* cited by examiner

STRUCTURED BLANKET ASSEMBLY

BACKGROUND OF THE INVENTION

The present invention relates to a structured beach blanket.

Beachgoers commonly use beach blankets upon which to lie in the sand. Unfortunately, at times, wind blows sand onto the blanket and the user. Also as the sunbather moves on the blanket, the blanket can easily shift getting sand on the blanket and user.

BRIEF SUMMARY OF THE INVENTION

The subject invention is directed to a structured blanket that defines a walled enclosure in which a user can lie protected from unwanted, such as blowing sand at a beach. In addition, because the subject assembly is structured with supported upstanding walls, the assembly is quite stable and adapted to keep sand off the blanket and user.

In accordance with one aspect of the invention the structured beach blanket is easily collapsible for easy carrying and also adapted for easy assembly for use.

Figure 1:
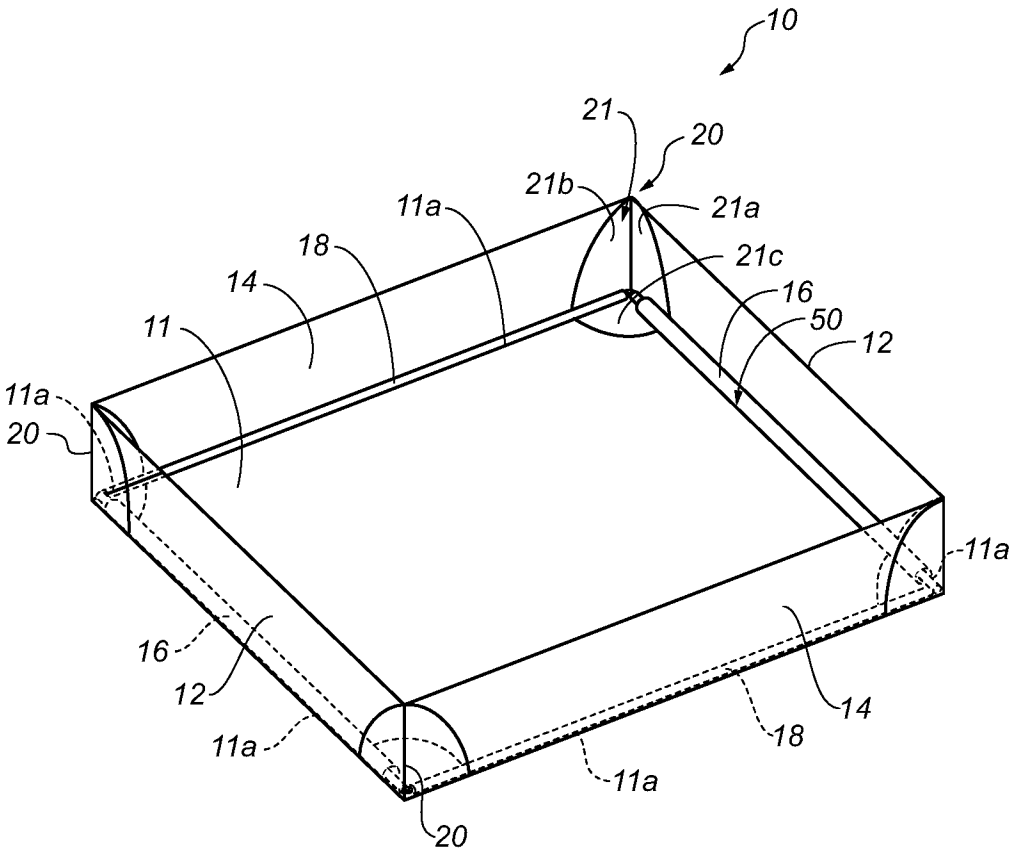
Referring to FIGS. 1 and 2, one embodiment of the structured beach blanket 10 is illustrated. As shown, beach blanket 10 includes a substantially rectangular base portion 11 having peripheral edge portions 11*a*. Base portion 11 can optionally be made of a durable and breathable material. Possible materials include, but are not limited to, cotton and nylon.

Extending upwardly and away from each edge portion 11 a is an upstanding wall member. As shown, there is a pair of opposed endwalls 12 and a pair of opposed side walls 14. Each endwall 12 may be connected substantially orthogonally to a sidewall 14 to form a corner 20. Endwalls 12 and side walls 14 may be made from a fabric or flexible plastic material or other durable material. In accordance with one aspect of the invention, base portion 11 may be integral with endwalls 12 and sidewalls 14 and formed from the same material as endwalls 12 and sidewalls 14.

In according with another aspect of the invention, the structured beach blanket 10' may include a corner support member 21 having a corner portion 21*a* disposed on an endwall 12, another corner portion 21*b* disposed on adjacent sidewall 14, and a further corner portion 21 c disposed on base portion 11. Corner support member 21 may be formed from an elastic, semi rigid material such that corner portions 21*a*, 21*b* and 21*c* can easily be forced to collapse on themselves but which, when, released, spring back to their original form to keep the endwalls 12 and sidewalls 14 upstanding. The corner support members 21 may optionally be positioned on the exterior, interior, or within the sidewalls, endwalls and base portion.

Figure 2:
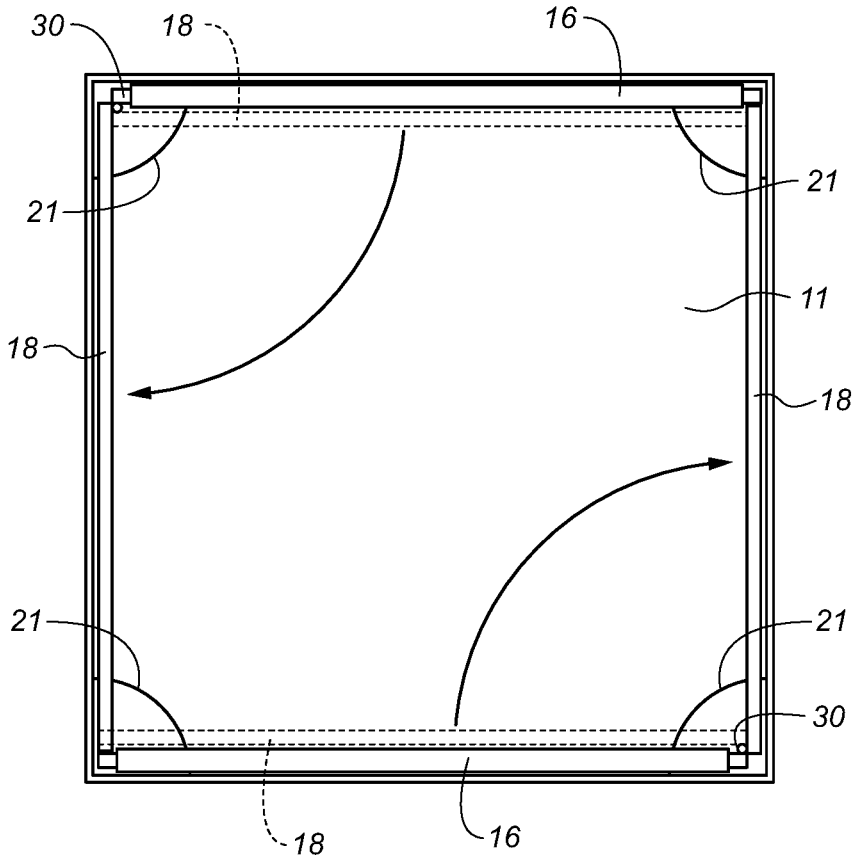

Further referring to FIGS. 1 and 2, structured beach blanket 10 includes a pair of opposed endwall support members 16 each being disposed along each endwall 12. In accordance with one aspect of the invention, each endwall support member 16 is disposed where an endwall 12 meets the base portion 11. In one embodiment the support members 16 and 18 each separately comprise integral members. In an alternate embodiment each support member 16 and 18 may separately be comprised of smaller components. For example, in the situation where the total length of the side wall is 8 feet, support members 18 may each be comprised of two 4 foot sections that are removably attached together. This removable attachment can allow for easier transportation or storage of the device.

In accordance with another aspect of the invention, the endwall support members 16 may be disposed within a cover 50 such that the ends of support members 16 extend beyond cover 50. In accordance with another aspect of the invention, one end of each endwall support member 16 may be connected to a hinge member 30. The other end of each endwall support member 16 may be associated with a holding member 40 that will be described in more detail below.

Figure 3:
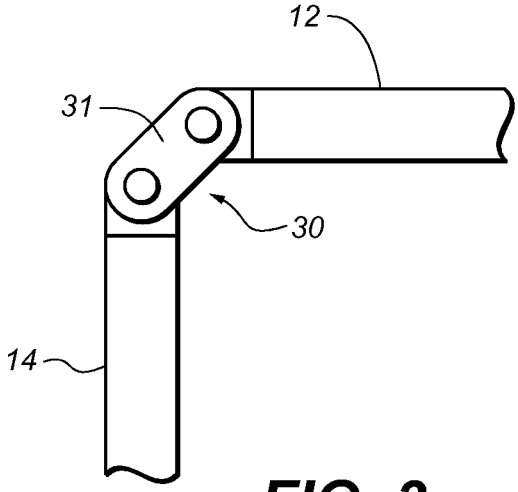
Figure 4:
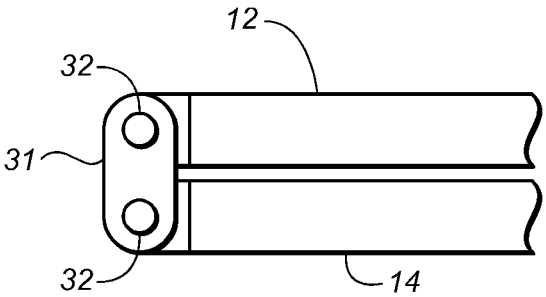
Figure 5:
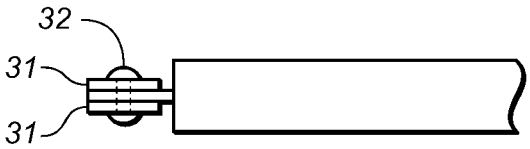

Referring to FIGS. 3-5, hinge member 30 may comprise a pair of hinge plates 31 that may sandwich an endwall support extension 16*a* and have a rivet 32 connecting the hinge plates 31 and extension 16*a*.

Referring back to FIGS. 1-2, one embodiment of the subject structured blanket 10 may include a pair of opposed sidewall support members 18, each of which being disposed along sidewall 14.

In accordance with one aspect of the invention, one end of sidewall support member 18 may be connected to a hinge member 30 such that an endwall support member 16 and a sidewall support member 18 are hingedly connected to one another.

As shown in FIGS. 3-5, each sidewall support member 18 may be connected to hinge 30 by a second rivet 32 so as to give endwall support member 16 and sidewall support member 14 two pivot points.

Referring to FIG. 2, it can be seen that in accordance with one aspect of the invention, sidewall support members 18 can be disposed in a first fully extended position (shown in solid lines) such that both pairs of endwall support members 16 and sidewall support members 18 provide support around the entire periphery of the blanket 10 to help support endwalls 12 and sidewalls 14 and keep them upright along with corner support members 21. Each sidewall support member 18 can also be pivoted in the direction of the illustrated arrows toward an endwall support member 16 such that each sidewall support member 18 lies along an endwall support member 16 (shown in dotted lines).

Figure 6:
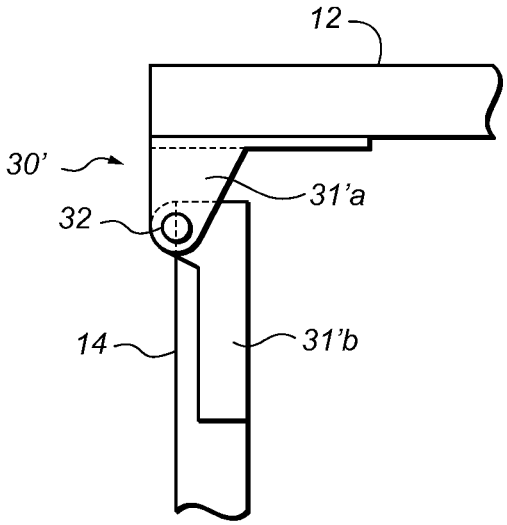
Figure 7:
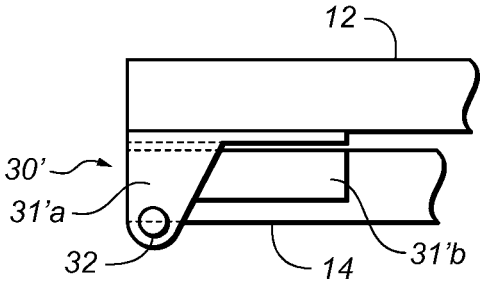
Figure 8:
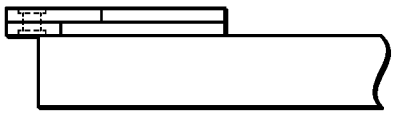

Referring to FIGS. 6-8, there is illustrated another embodiment of a hinge assembly for hingedly connecting an endwall support member 16 with a sidewall support member 18. As shown, the hinge 30' may include a first hinge portion 31'*a* fixed to endwall support member 16, a second hinge portion 31'*b* fixed to sidewall support member 18, the first and second hinge portions being hingedly connected by a rivet 32.

Figure 9:
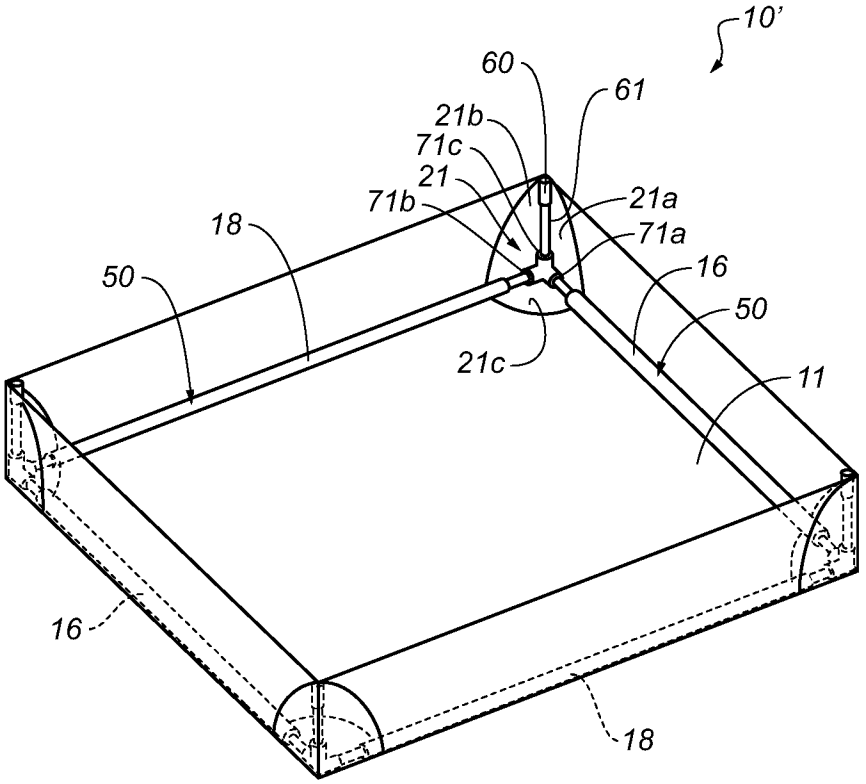
Figure 10:
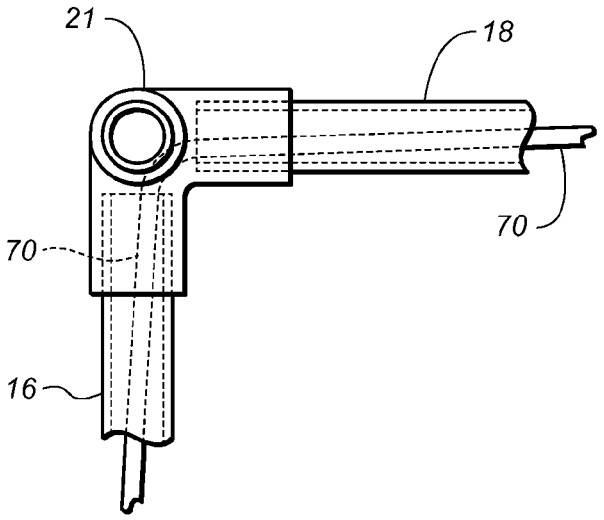

Referring to FIGS. 9-10, there is illustrated another embodiment of the subject invention. As shown, the structured beach blanket 10 includes a substantially rectangular base portion 11 defining a peripheral edge 11*a*. Base portion 11 may be made from a durable, breathable fabric or other appropriate material. Extending upwardly and away from base portion 11 are a pair of opposed endwalls 12 and a pair of sidewalls 14. Each endwall 12 may be connected orthogonally to a sidewall 14 to form a corner 20. In one aspect of the invention, endwalls 12 and sidewalls 14 may be integral with base 11 and formed from the same material as base 11.

In accordance with another aspect of the invention, the structure beach blanket 10 includes a plurality of corner support members 21 that may be made from an elastic, semi rigid material. As shown, each corner support member 21 may include a corner portion 21*a* disposed on an endwall 12, a corner portion 21*b* disposed on a sidewall 14 and a corner portion 21 c disposed on base 11. In accordance with one aspect of the invention, each corner support portion may include a connector 60 for receiving a corner support member 61 as will be described below.

Further referring to FIG. 9, the structured beach blanket 10' includes a pair of opposed endwall support members 16 and a pair of opposed sidewall support members 18. As shown, each endwall support member 16 and sidewall support member 18 may be disposed in a casing 50 that may be attached to its associated endwall 12 or sidewall 14 or to the base 11 or both to its associated endwall 12 or sidewall 14 and to the base 11. As shown, each endwall support member 16 and each sidewall support member 18 has two ends that extend from their respective casing 50.

In accordance with another aspect of the invention, the structured beach blanket 10 may include a plurality of corner connectors 71 having a receptacle 71*a* for receiving an end of an endwall support member 12, a receptacle 71*b* for receiving an end of a sidewall support member 18 and a receptacle 71*c* for receiving one end of a corner support member 61. The other end of corner support 61 is receivable in connector 60.

In accordance with another aspect of the invention, each endwall support member 16 and sidewall support member 18 may be hollow for receiving an elastic shock cord 70. It is also contemplated that each corner connector 21 has a passageway for receiving elastic shock cord 70.

In accordance with one aspect of the invention, the structured beach blanket 10' may include a single shock cord that is received through each of the endwall support 16 members, sidewall support members 18 and corner connector 21. Alternatively, there may be more than one shock cord, with different shock cords being disposed in a different endwall support member or sidewall support member.

Figure 11:
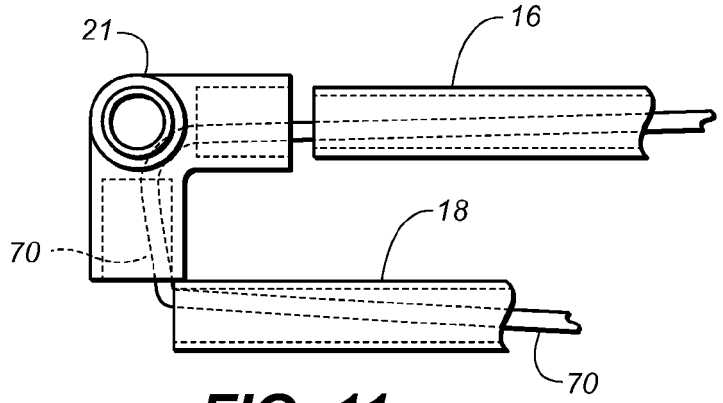
Figure 12:
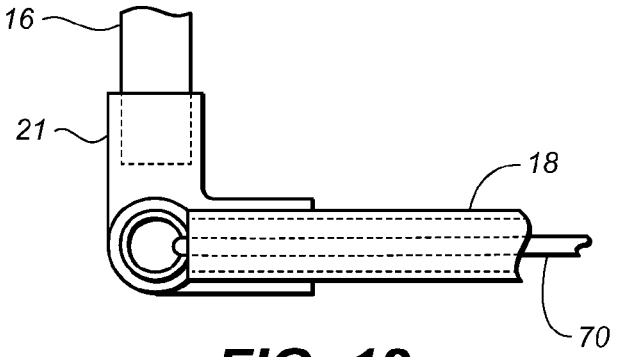

As shown in FIGS. 10-12, shock cord 70 facilitates the assembly of endwall support members and sidewall support members into corner connectors 21 as well as the maintenance of the endwall support members and sidewall support members into the corner connectors.

In a further embodiment, there is only one endwall or side wall present, resulting in an open side to the structured blanket. In a separate embodiment, each of the endwall or side walls may include gaps in the overall wall.

In another further embodiment it is possible to further adapt the structured beach blanket to allow connection to other structured beach blankets by removing the appropriate endwalls or side walls.

While the blanket assembly is described above with respect to its use in a beach setting, the blanket assembly may also be modified for use in other settings such as picnics, camping, and any other setting where it is desired to avoid unwanted objects from the surface of a blanket or similar object.

What is claimed is:

1. A structured blanket comprising:

a generally rectangular base sheet portion;

a pair of opposed endwall sheets extending away from the base sheet portion;

a pair of opposed sidewall sheets extending away from the base sheet portion, each sidewall sheet being connected to an endwall sheet to define a corner;

a plurality of corner support members disposed at each corner, each corner support member formed of an unitary elastic, semi-rigid material including:

an endwall portion of the elastic, semi-rigid material engaged with one of the endwall sheets and having a substantially similar height as the endwall sheet, a sidewall portion of the elastic, semi-rigid material engaged with one of the sidewall sheets and having a substantially similar height as the sidewall sheet, and a base portion engaged with the base sheet portion;

a pair of endwall support members, each being respectively disposed along one of the endwall sheets;

a pair of sidewall support members, each being respectively disposed along one of the sidewall sheets, each sidewall support member having one end hingedly connected to an end of an endwall support member such that each sidewall member can be pivoted to a first position along an endwall support member and a second position orthogonal to said first position; and wherein unitary elastic, semi-rigid material of the corner support members can deform when said sidewall support members are pivoted to the first position and when said sidewall support members are pivoted to the second position the unitary elastic, semi-rigid corner support members can elastically return to their original position.

2. The structured blanket of claim 1 wherein the base sheet is a square.

3. The structured blanket of claim 1 wherein the base sheet portion of the blanket is made of a material selected from the group consisting of nylon and cotton.

4. The structured blanket of claim 3 wherein the side walls and endwalls are made of the same material as the base sheet portion of the blanket.

5. The structured blanket of claim 1 wherein the endwall support members and sidewall support members are hollow.

6. The structure blanket of claim 5 wherein disposed in the hollow portion of the endwall and sidewall members are at least one elastic shock cords.

* * * * *